United States Patent [19]

Grider et al.

[11] Patent Number: 4,546,741

[45] Date of Patent: Oct. 15, 1985

[54] THROTTLE BODY WITH SLIDABLE THROTTLING VALVE

[75] Inventors: Duane M. Grider, Detroit; Theodore W. Daykin, Dearborn, both of Mich.

[73] Assignee: Ford Motor Company, Dearborn, Mich.

[21] Appl. No.: 689,128

[22] Filed: Jan. 7, 1985

[51] Int. Cl.[4] ..... F02D 9/08

[52] U.S. Cl. ..... 123/337; 123/378; 261/65

[58] Field of Search ..... 123/337, 401, 378, 470; 261/65

[56] References Cited

U.S. PATENT DOCUMENTS

| | | | |
|---|---|---|---|
| 2,025,091 | 12/1935 | Chandler | 123/505 |
| 2,740,391 | 4/1956 | Busch | 123/337 |
| 3,916,846 | 11/1975 | Kromer | 123/337 |
| 4,108,127 | 8/1978 | Chapin et al. | 123/337 |
| 4,300,506 | 11/1981 | Knapp et al. | 123/337 |
| 4,419,972 | 12/1983 | Hattori et al. | 123/337 |

FOREIGN PATENT DOCUMENTS

| | | | |
|---|---|---|---|
| 2743124 | 3/1978 | Fed. Rep. of Germany | 123/337 |
| 2743125 | 3/1978 | Fed. Rep. of Germany | 123/337 |

*Primary Examiner*—Magdalen Y. C. Moy

*Attorney, Agent, or Firm*—Clifford L. Sadler; Robert E. McCollum

[57] ABSTRACT

An air atomizing throttle body is formed with a single point fuel injector located above the inlet to the throttle body induction passage, the throttle body having an inverted cup-shaped sleeve valve, the lower edges of which cooperate with a stationary conical valve seat projecting radially into the induction passage to define a variable area flow path, and including idle speed air vents to equalize pressures on opposite sides of the sleeve valve to minimize the force needed to move the valve by a pressure operated bellows incorporated into the valve, the valve members forming a labryinthian type air/fuel flow path for the shearing of the fuel globules to atomize the same.

7 Claims, 4 Drawing Figures

FIG.4
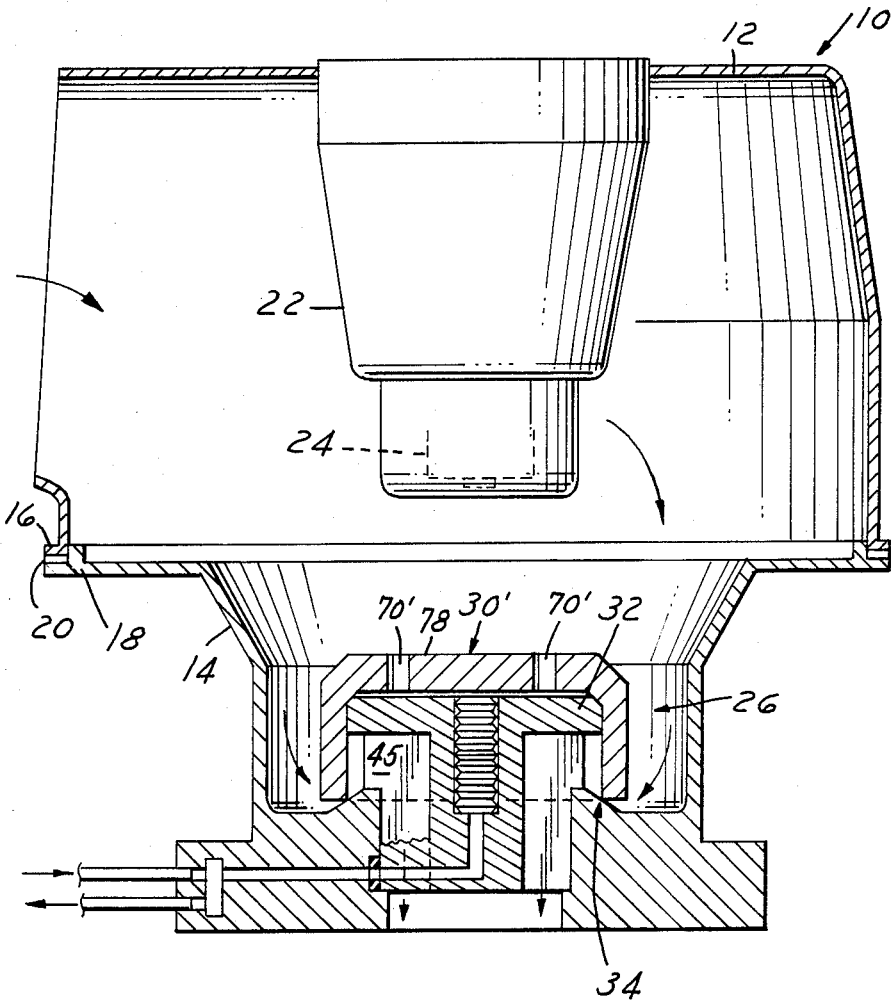
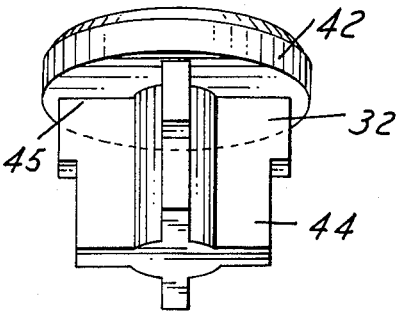
FIG.3
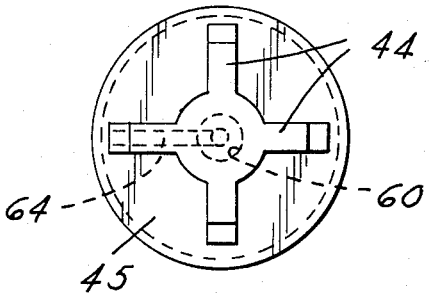
FIG.2

THROTTLE BODY WITH SLIDABLE THROTTLING VALVE

This invention relates in general to a fuel injection system of the single point, throttle body type, and more particularly, to one that includes an axially slideable throttle valve for variably controlling the flow of air and fuel into the induction passage.

More specifically, the invention relates to an air throttle body having a fuel injector concentrically mounted above the entrance to the air/fuel induction passage for the spray of fuel thereinto, and a throttling type sleeve valve axially movable by fuel pressure bellows means to meter the flow of air and fuel into the engine in a manner to also atomize the fuel.

Throttle bodies with fuel injectors and/or longitudinally moveable throttling valves are known, as also are conventional throttle valves moved by fuel pressure operated bellows. For example, Knapp, et al, U.S. Pat. No. 4,300,506 shows a dome-like throttling valve pivotally movable in a throttle body induction passage below a fuel injector. Chapin, et al, U.S. Pat. No. 4,108,127 shows in FIG. 2 a rotatable double cone-type equalizer valve located beneath a fuel injector, the cones having overlapping apertures controlling the flow. Kromer, U.S. Pat. No. 3,916,846 shows a conically mating valve arrangement in an engine intake manifold for controlling the flow of fuel and air in a rotary engine. Chandler, U.S. Pat. No. 2,025,091 shows in FIG. 1 a fuel pressure movable bellows to rotate a conventional carburetor throttle valve.

It will be clear from the above, however, that a throttle body is not shown in which the air flow is controlled by vertical movement of a slidable cup-like member located directly beneath a fuel injector and cooperating with a valve seat on the throttle body to variably control the air/fuel flow in a labrynthian-like path to provide a shearing action on the fuel to atomize the same, the valve being provided with means to balance the air pressures acting on opposite surfaces of the throttle valve to minimize the force necessary to move the valve during engine idling conditions when the pressure differential across the valve is high.

It is a primary object of the invention, therefore, to provide a throttle body of the type described above, one having an axially moveable air/fuel metering valve means cooperating with a valve seat to variably meter air/fuel flow in a manner to also atomize the fuel.

Other objects, features and advantages of the invention will become more apparent upon reference to the succeeding detailed description thereof, and to the drawings illustrating the preferred embodiments thereof: wherein, FIG. 1 is a schematic cross-sectional view of a throttle body embodying the invention;

FIG. 2 is a bottom view looking up of a detail shown in FIG. 1;

FIG. 3 is a perspective view of a detail of FIG. 1; and

FIG. 4 is a view similar to FIG. 1, illustrating a modification.

Figure 1:
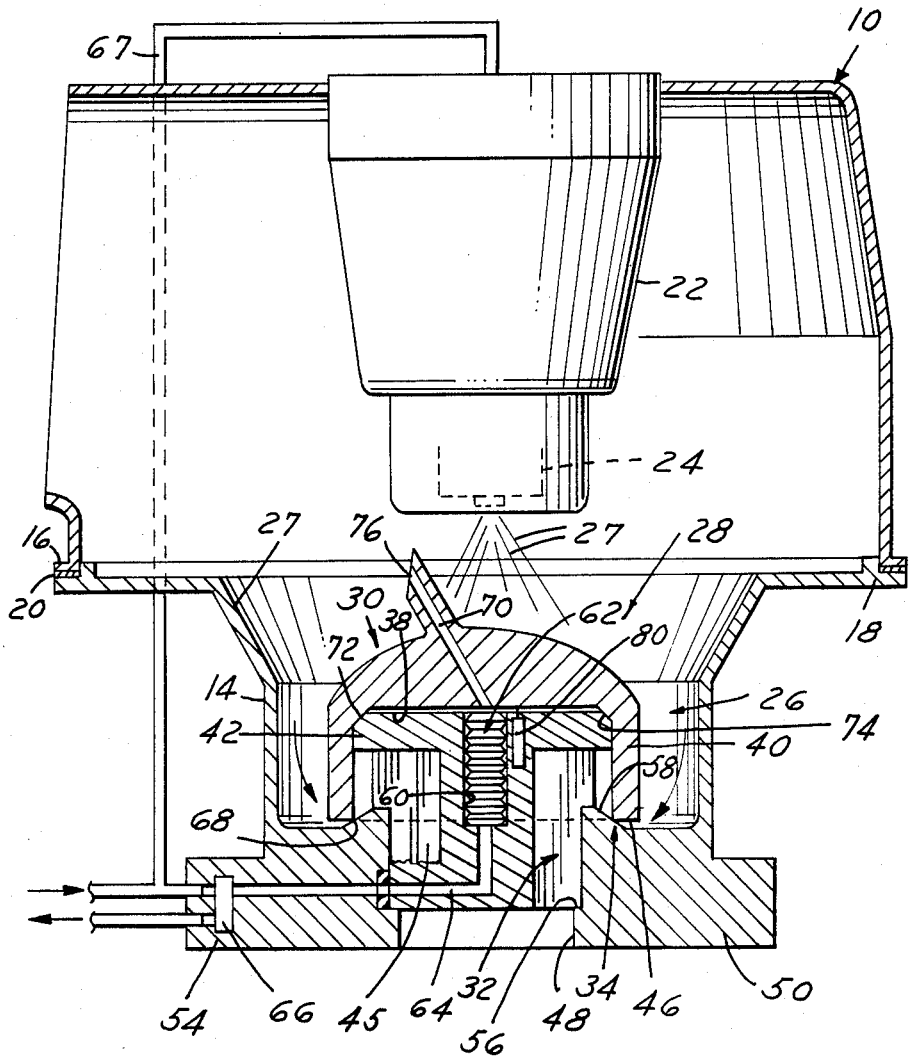

The throttle body 10 of the invention includes a two-piece housing consisting of an upper air horn or cover portion 12 bolted to a lower combination main fuel charging and throttle body portion 14. Upper portion 12 is adapted to be connected at its leftward end, as seen in FIG. 1, to the clean air side of a conventional automotive type air cleaner, not shown, for receiving air therefrom at an essentially atmospheric or ambient pressure level. The lower portion 14 is adapted to be bolted onto the engine intake manifold, not shown, to subject the throttle body to the change in vacuum levels therein.

The air horn 12 is essentially L-shaped in cross-section with a square bottom flange 16. The flange mates with a similarly shaped flange 18 formed on the main fuel charging portion 14, an annular gasket 20 being sandwiched between the two. The inlet end of the air horn is shown with an oval shape for compactness and to provide a low profile. It is shaped with a well-like housing at 22 for the mounting therein in a well of fuel of a known type of fuel injector 24.

The housing 12 is shaped internally to flow air around the lower portion of the injector housing to cool the injector fuel while also maintaining an annular flow of air to the induction passage 26 formed in lower body portion 14. Flange 18 is flared at the inlet to passage 26, as shown, to minimize restriction of flow of the air into the induction passage.

The fuel injector 24 is concentrically mounted above the inlet to induction passage 26 for the spray of fuel thereinto in a conical-like pattern indicated by dotted lines 27.

The flow of air and fuel through the induction passage 26 is controlled by an axially movable or slidable throttling valve 28. The latter consists essentially of three pieces, a vertically movable dome-shaped valve member 30, a stationary support 32, and a fixed valve seat 34. The dome-shaped valve member 30 has an inverted cup shape defining a somewhat semi-spherical outer surface and a flat horizontal inner surface 38. Both surfaces are integral with an annular vertically depending side wall 40.

The movable valve member 30 is supported on and slides over the stationary support 32. The latter is essentially T-shaped, as best seen in FIGS. 2 and 3, with a flat button-like top portion 42 that mates with the flat undersurface 38 of valve member 30. The body portion of support 32 is defined by four circumferentially spaced vertically extending legs 44. The spacing defines four windows or passages 45 connecting the flow of air and fuel from around the lower edge 46 of side wall 40 and under the top 42 into the induction passage 26.

The induction passage 26 in this case is defined by the central opening 48 of a washer-like extension 50 of the throttle body lower portion 14 that includes the valve seat 34. More specifically, throttle body portion 14 has an inwardly extending annular projection of the lower mounting flange 54 to define opening 48 with a stepped diameter. The step 56 serves as a vertical stop for locating support 32, which could be press fitted in the opening. The upper surface of projection 52 is formed with a conical surface 58 that defines a valve seat cooperating with the inside edge 46 of wall 40 to meter the flow of air and fuel therepast.

Support 32 is formed with a central well 60 within which is located a sealed fluid bulb or bellows 62. The bellows is connected at its lower end to a fuel passage 64 that interconnects with a source of fuel, as indicated, under pressure past a control valve 66. The source in this case, as indicated at 67, is the same as that supplying fuel to the injector 24; however, it will be clear that it can be any suitable source under control of a selectively or automatically operable electrical control unit.

Supply of fuel to bellows 62 will expand it vertically against the dome-shaped valve member 30, pushing it upwardly and thereby increasing the air/fuel flow clearance space 68 between edge 40 and the valve seat 58. Alternatively, decreasing the fuel pressure will allow the bellows to collapse under the force of the air and fuel against the domed surface of member 30.

FIG. 1 shows the dome 30 with an air pressure balancing passage 70 connecting the outer and inner surfaces of the dome. This essentially balances the air pressure on opposite sides of the dome to reduce the actuating force necessary to move the dome member at engine idle or part throttle settings. More particularly, when the engine is conditioned for an idle speed operation, the position of the dome member 30 is essentially as shown. The lower edge 46 of the wall 40 is essentially in contact with the conical valve seat 58, providing only that amount of air flow necessary for engine idle speed operation. The top of the dome member at this time is essentially in contact with the top of the T-shaped support 32. The pressure differential across the small opening 68 between the edge 46 and valve seat 58 will be largely due to the high engine manifold vacuum. The beveled mating edges 72, 74 of the dome and T-member provide a seal along this line, and the high engine suction force normally would provide a high unbalanced air force acting downwardly on the dome 30. This would require a large opposing force by bellows 60 to open the valve. However, the air vent passage 70 compensates for this by balancing the air pressures on opposite surfaces of the dome member, thereby minimizing the force necessary to move the valve member 30 vertically.

The vent passage shown in FIG. 2 has an upward extension 76 that constitutes a fuel deflector to minimize the amount of fuel drops or globules entering the passage. FIG. 4 shows an alternate construction where the upper surface 78 of the dome member 30 in this case is flat, and formed with a member of air vent passages 70 for the same purpose.

The operation is believed to be clear from the above description, and, therefore, will not be given in detail. However, briefly, during engine idle speed operation, the fuel injector 24, which would be electromagnetically pulsed to provide a predetermined fuel flow schedule, will deliver a scheduled flow of fuel out through its nozzle in the conical spray pattern indicated. Simultaneously, the manifold vacuum of the engine will induce a flow of air from the air horn portion 12 into the induction passage 26 and around injector 24, as indicated by the arrows. At idle speed operation, the throttling valve member 30 in in the position indicated providing the smallest cross-sectional flow area at the annular flow path 68. A portion of the intake air will be metered through the clearance space. The labrynthian passage defined by the parts and indicated by the arrows causes a shearing action on the fuel, thus effectively atomizing the fuel and mixing it with the air for efficient combustion.

Supply of fuel to the bellows 62 in response to the opereator depressing the conventional accelerator pedal will expand the bellows to raise the dome valve member 30 proportionately. A linear action potentiometer type position sensor 80 can be used to provide a feedback signal to the control 66 to stop movement of the valve member when it has reached the correct position.

It will be clear that the valve member 30 alternatively could be secured to the conventional vehicle accelerator pedal by a direct mechanical linkage to mechanically control movement of the valve member.

From the foregoing, it will be seen that the invention provides an axially slidable throttle body particularly adapted for use with a single point, centrally located type fuel injector and one that eliminates the conventional rotatable throttle valve to provide not only a controlled, variable area air flow into the engine, but also a flow that provides a shearing action on the fuel to atomize the fuel in a manner providing efficient operation of the engine.

While the invention has been shown and described in its preferred embodiments, it will be clear to those skilled in the arts to which it pertains that many changes and modifications may be made thereto without departing from the scope of the invention.

We claim:

1. A central fuel injection type fuel feed system for an automotive type internal combustion engine including an air/fuel throttling body having wall means defining an air/fuel induction passage therethrough open at one end to air essentially at an atmospheric pressure level and adapted to be connected at its opposite end to the intake manifold of the engine to subject the passage to the varying vacuum levels therein, a fuel injector means concentrically positioned in the passage near the inlet thereto for discharge of fuel axially into the passage with a conical-like spray pattern, and an air/fuel throttling valve means in the passage for controlling the flow of air and fuel to the intake manifold, the valve means including an interengaging arrangement of an axially moveable dome-like valve member with an annular washer-like valve seat having a central opening, the arrangement defining a controlled air/fuel flow path between the member and valve seat varying in area as a function of the axial separation of the two, and aperture means in the dome-like member communicating the air to opposite sides of the member to essentially balance the pressure on opposite sides thereof, thereby reducing the force necessary to move the member axially, the passage of fuel through the controlled path effecting a shearing action of the fuel for atomizing the fuel.

2. A fuel system as in claim 1, wherein the dome-like member has an inverted cup-like shape with a base portion and a vertically depending annular side wall portion spaced radially inwardly of the wall means and cooperating therewith to form the controlled path.

3. A fuel system as in claim 2, the valve seat including a conical-like ramp adjacent the inner edge that defines the central opening, the ramp cooperating with the lower edge of the side wall to define a controlled flow area therebetween.

4. A fuel system as in claim 3, wherein the member is concentrically located within the passage downstream of the injector means to receive the fuel discharged therefrom against an upstream surface of the member for flow by gravity downwardly towards the controlled flow path area.

5. A fuel system as in claim 3, including fuel pressure responsive means operatively connected to the member for moving the dome-like member axially to vary the controlled flow area.

6. A fuel system as in claim 5, wherein the fuel responsive means is an expandable bellows.

7. A fuel system as in claim 1, wherein the aperture means includes a plurality of apertures in the base portion operable when the valve member is close to engaging the valve seat during an engine idle speed condition.

* * * * *